US006627264B1

(12) United States Patent
Tomita et al.

(10) Patent No.: US 6,627,264 B1
(45) Date of Patent: Sep. 30, 2003

(54) METHOD OF MANUFACTURING AN INK-JET PRINT HEAD COATED WITH A WATER REPELLENT THIN FILM

(75) Inventors: Kenji Tomita, Kumamoto (JP); Tohru Nakagawa, Shiga (JP); Mamoru Soga, Osaka (JP); Keisuke Shimamoto, Kumamoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/538,762

(22) Filed: Mar. 30, 2000

(30) Foreign Application Priority Data

Apr. 1, 1999 (JP) ..... 11-094794

(51) Int. Cl.[7] ..... B05D 1/36; B05D 5/00; B05D 3/14

(52) U.S. Cl. ..... 427/387; 427/264; 427/407.1

(58) Field of Search ..... 428/35.7, 446, 428/447; 347/37, 35, 45, 71, 20; 427/372.2, 387, 407.1, 264; 106/287.1, 287.12, 287.16, 287.13

(56) References Cited

U.S. PATENT DOCUMENTS 4,368,476 A * 1/1983 Uehara et al. ..... 346/140
4,643,948 A * 2/1987 Diaz et al. ..... 428/422
5,010,356 A * 4/1991 Albinson ..... 346/140
5,701,148 A * 12/1997 Moynihan et al. ..... 347/92

FOREIGN PATENT DOCUMENTS

JP 06087216 A 3/1994 ..... B41J/2/135

* cited by examiner

*Primary Examiner*—Katherine A. Bareford
*Assistant Examiner*—William Phillip Fletcher, III
(74) *Attorney, Agent, or Firm*—Harness, Dickey & Pierce, P.L.C.

(57) ABSTRACT

A coat liquid, in which a methoxysilane or ethoxysilane compound which is a precursor of silicon oxide and an ethoxysilane or methoxysilane compound which contains therein a carbon fluoride chain are dissolved, is applied onto the surface of a base material of SUS having a thickness of 20 μm. This is followed by drying the base material for one hour at room temperature condition. Thereafter, the base material is baked at 200 degrees centigrade for 30 minutes thereby to form a water repellent thin film having a thickness of from 10 nm to 1000 nm and containing therein a molecule in which fluoroalkyl chains are bonded to the silicon oxide. A nozzle orifice is formed by electrical discharge machining from the lower side of the base material.

2 Claims, 4 Drawing Sheets

(a)

$Si(OC_2H_5)_4 + 4H_2O \rightarrow Si(OH)_4$ $CF_3(CF_2)_7C_2H_4Si(OCH_3)_3 + 3H_2O \rightarrow CF_3(CF_2)_7C_2H_4Si(OH)_3$

BAKING (b)

$$Si(OC_2H_5)_4 + 4H_2O \rightarrow Si(OH)_4$$

$$CF_3(CF_2)_7C_2H_4Si(OCH_3)_3 + 3H_2O \rightarrow CF_3(CF_2)_7C_2H_4Si(OH)_3$$

BAKING

CF3(CF2)7C2H4Si
CF3(CF2)7C2H4Si
CF3(CF2)7C2H4Si
OH
HO
OH
HO
OH
HO

METHOD OF MANUFACTURING AN INK-JET PRINT HEAD COATED WITH A WATER REPELLENT THIN FILM

FIELD OF THE INVENTION

The present invention relates to an ink jet head, and to a method for the manufacture thereof. More specifically, the present invention relates to an ink jet head comprising a nozzle member on which surface a thin film having water repellency has been formed, and to a method for the manufacture of such an ink jet head.

BACKGROUND OF THE INVENTION

With the recent improvement in operation speed and image quality, and the reduction in production cost of recording devices such as a printer, a word-processing machine, a facsimile machine, or the like, many of the recording devices employ an ink jet recording method. Typically, the ink jet head employed in such an ink jet recording device has nozzles from which ink droplets are jetted toward a recording medium such as a sheet of paper on which these ink droplets land to effect printing.

Incidentally, if water repellency at a portion surrounding a nozzle orifice of the nozzle member is insufficient, this will cause the ink to readily adhere to the surrounding portion. If ink adheres to a portion surrounding a nozzle orifice, this will reduce the linearity in travel direction of ink droplets jetted from that nozzle orifice. It is therefore difficult to effect satisfactory printing. To cope with such a problem, a water repellent film is usually formed on the surface of a nozzle member, as disclosed in, for example, Japanese Unexamined Patent Gazette No. H06-87216.

Water repellent films which are formed on the surface of nozzle members are roughly divided, by formation method, into two types, namely water repellent films of the application type and plasma polymerization films. The application-type water repellent film is a film formed by application of a water repellent material on the surface of a nozzle member by dipping, spray-coating, or spin-coating. On the other hand, the plasma polymerization film is a film formed by plasma polymerization.

Generally, in a typical ink jet head, cleaning including wiping of ink adhered to the surface of a nozzle member is carried out at regular intervals. However, although the film thickness of conventional water repellent films of the application type is not thin at all, these water repellent films readily come to peel off and are poor in abrasion resistance. In other words, wiping causes such a conventional water repellent film to readily peel off and wear out. For this reason, it is difficult to maintain water repellency over a long period. Accordingly, in order to improve abrasion resistance, the film thickness may be increased to a further extent. However, if the film thickness is too thick, this will result in distortion in film shape when nozzle orifices are formed and sagging in the vicinity of the nozzle orifices. Due to such drawbacks, the state of jetting ink droplets is likely to become unstable.

Conversely, the film thickness formable by plasma polymerization is just 10 nm at most, so that plasma polymerization films are likely to be poor in abrasion resistance because of their thinness. Moreover, since the degree of adhesion between the film and the base material (i.e., the nozzle member) is generally poor, it is required to provide an adhesive layer, such as an inorganic film, between them in order to improve the degree of adhesion. Furthermore, the plasma polymerization requires the provision of vacuum equipment. Moreover, the plasma polymerization requires a greater number of process steps for the formation of water repellent films. As a result, the cost of equipment increases considerably.

Bearing in mind the above-described points, the present invention was made. Accordingly, an object of the present invention is to provide an ink jet head in which a water repellent thin film, which is less readily peelable, superior in abrasion resistance, and capable of easily making the state of jetting ink droplets stable, is formed and to provide a method for the manufacture thereof.

SUMMARY OF THE INVENTION

In order to achieve the object, the present invention provides an ink jet head. The ink jet head of the present invention comprises a nozzle member on which surface a water repellent thin film, containing therein a molecule in which fluoroalkyl chains are bonded to or dispersed in silicon oxide, has been formed.

As a result of such arrangement, the silicon oxide enhances abrasion resistance, while the fluoroalkyl chain imparts water repellency, whereby an ink jet head having a water repellent thin film superior in abrasion resistance and having a long life span can be achieved.

It is preferred that the water repellent thin film is formed, having a thickness of from 10 nm to 1000 nm.

Water repellent thin films are likely to peel off and undergo a drop in abrasion resistance if their film thickness is too thin. On the other hand, if the film thickness is too thick, then there occurs distortion in film shape and cracking is likely to occur. If it is arranged such that the film thickness is from 10 nm to 1000 nm, this makes it possible to form a water repellent thin film which is uniform in film shape, superior in abrasion resistance, and capable of jetting ink droplets in a stable manner. Further, being thin in film thickness, the water repellent thin film of the present invention facilitates the miniaturization of nozzles. Moreover, because of its thinness, the water repellent thin film of the present invention comes to derive a high heat conductivity, therefore being unsusceptible to ill effects such as thin film damage and peeling-off at the time when nozzle orifices are formed by laser beam machining or electrical discharge machining. Moreover, being superior in adhesion, even when nozzle orifice formation is carried out using mechanical machining such as punching machining, the water repellent thin film of the present invention will not peel off at the time of such machining. This therefore allows mechanical machining to easily form nozzle orifices.

It is preferred that the water repellent thin film is formed such that the density of the fluoroalkyl chain-containing molecule at the side of an upper surface of the water repellent thin film is thicker than that at the side of an interface between the water repellent thin film and the nozzle member.

Generally, molecules which impart water repellency exhibit poor adhesion for the nozzle member (i.e., the base material). However, as a result of the above-described arrangement, the fluoroalkyl chain-containing molecule is less dense at the interface between the water repellent thin film and the nozzle member, thereby providing a satisfactory degree of adhesion between the water repellent thin film and the nozzle member. On the other hand, at the side of the upper surface of the water repellent thin film the density of the fluoroalkyl chain-containing molecule thickens, thereby increasing the water repellency.

The present invention provides a method of manufacturing an ink jet head. More specifically, the present invention discloses a method of manufacturing an ink jet head having a nozzle member on which surface a water repellent thin film has been formed, the method comprising the steps of (a) applying, onto a surface of the nozzle member, a coat liquid in which a methoxysilane or ethoxysilane compound which is a precursor of silicon oxide and an ethoxysilane or methoxysilane compound containing therein a carbon fluoride chain are dissolved and (b) thereafter, drying the nozzle member.

By a process of "drying" used here may be meant only one of dehydration and thermal baking or both of them.

Because of such arrangement, it is possible to form a water repellent film, only by applying the coat liquid onto the surface of the nozzle member in an atmosphere at room temperature. This therefore provides a method of manufacturing an ink jet head which requires a less number of process steps and which is inexpensive in production cost. Moreover, unlike the plasma polymerization thin film formation, there is no need to place a nozzle member in the vacuum furnace when forming a water repellent thin film. This facilitates producing thin films with a larger area.

The present invention provides another method of manufacturing an ink jet head. More specifically, the present invention discloses a method of manufacturing an ink jet head having a nozzle member on which surface a water repellent thin film has been formed, the method comprising the steps of (a) applying, onto a surface of the nozzle member, a first coat liquid in which a methoxysilane or ethoxysilane compound which is a precursor of silicon oxide is dissolved, (b) applying, onto the nozzle member surface coated with said first coat liquid, a second coat liquid in which a methoxysilane or ethoxysilane compound which is a precursor of silicon oxide and an ethoxysilane or methoxysilane compound which contains therein a carbon fluoride chain are dissolved, and (c) thereafter, drying the nozzle member.

Accordingly, the first coat liquid includes neither a carbon fluoride chain-containing ethoxysilane compound nor a carbon fluoride chain-containing methoxysilane compound. This means that the water repellent thin film contains, at its portion in the vicinity of an interface with the nozzle member, little water repellent molecule, therefore enhancing the degree of adhesion between the water repellent thin film and the nozzle member.

The present invention provides still another method of manufacturing an ink jet head. More specifically, the present invention discloses a method of manufacturing an ink jet head having a nozzle member on which surface a water repellent thin film has been formed; the method comprising the steps of (a) applying, onto a surface of the nozzle member, a coat liquid in which a methoxysilane or ethoxysilane compound which is a precursor of silicon oxide and an ethoxysilane or methoxysilane compound containing therein a carbon fluoride chain are dissolved, (b) thereafter, drying the nozzle member, and (c) thereafter, forming a nozzle orifice in the nozzle member.

As described above, since the formation of the orifice nozzle is preceded by that of the water repellent thin film, this ensures that the nozzle orifice is prevented from becoming clogged by the water repellent thin film, unlike the case in which the water repellent thin film is formed after the nozzle orifice formation.

The present invention provides another method of manufacturing an ink jet head. More specifically, the present invention discloses a method of manufacturing an ink jet head having a nozzle member on which surface a water repellent thin film has been formed, the method comprising the steps of (a) applying, onto a surface of the nozzle member, a first coat liquid in which a methoxysilane or ethoxysilane compound which is a precursor of silicon oxide is dissolved, (b) applying, onto the nozzle member surface coated with the first coat liquid, a second coat liquid in which a methoxysilane or ethoxysilane compound which is a precursor of silicon oxide and an ethoxysilane or methoxysilane compound which contains therein a carbon fluoride chain are dissolved, (c) thereafter, drying said nozzle member, and (d) thereafter, forming a nozzle orifice in the nozzle member.

As a result of such arrangement, the water repellent thin film contains, at its portion in the vicinity of an interface with the nozzle member, little water repellent molecule, therefore enhancing the degree of adhesion between the water repellent thin film and the nozzle member. Moreover, it is ensured that the nozzle orifice is prevented from becoming clogged by the water repellent thin film.

It is especially preferred that the nozzle orifice forming step, which is carried out after the water repellent thin film formation step, is a step of forming nozzle orifices by electrical discharge machining.

The use of an electrical discharge machining technique makes it possible to provide a wide-range setting of the taper angle of nozzle orifices. In addition, heat produced by electrical discharge machining causes water-repellency molecules contained in side-wall portions of the water-repellency thin film to vapor, wherein the inside of the nozzles becomes hydrophilic. This stabilizes the jetting of ink droplets.

As described above, in accordance with the present invention, it is possible to achieve an ink jet head in which a water repellent thin film, which is less readily peelable, superior in abrasion resistance, and capable of easily making the state of jetting ink droplets stable, has been formed.

The first arrangement, in which the water repellent thin film has a film thickness of from 10 nm to 1000 nm, facilitates the formation of uniform thin films having a neat film shape, therefore facilitating the miniaturization of nozzles.

The second arrangement, in which the molecule having a fluoroalkyl chain in the water repellent thin film is more dense at the side of the upper surface (i.e., right surface) of the water repellent thin film than at the side of the interface between the water repellent thin film and the nozzle member, not only enhances the degree of adhesion between the water repellent thin film and the nozzle member, but also improves water repellency at the surface.

The third arrangement, in which nozzle orifice formation is carried out by electrical discharge machining, makes it possible to provide a wide-range setting of the taper angle of nozzle orifices. Moreover, after the water repellent thin film is formed, the nozzle orifice is formed by means of electrical discharge machining. This causes water repellent molecules to vapor from side-wall portions on the nozzle orifice side of the water repellent thin film, whereby the jetting of ink droplets can be stabilized.

DESCRIPTION OF PREFERRED EMBODIMENTS

Embodiments of the present invention will be described below with reference to the accompanying drawing figures.

EMBODIMENT 1

Figure 1:
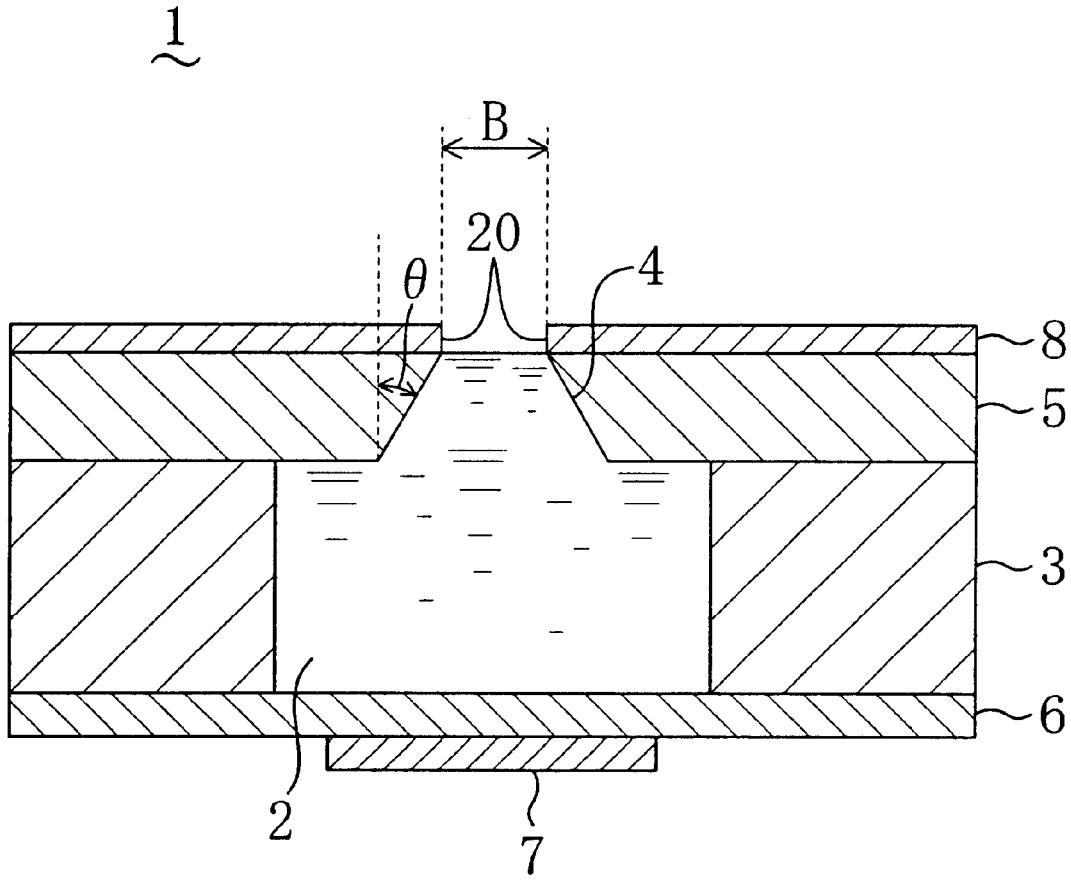
FIG. 1 is a cross-sectional view of an ink jet head.

As FIG. 1 shows, in an ink jet head 1 in accordance with a first embodiment of the present invention, a nozzle plate 5, in which a nozzle orifice 4 is formed, is fixedly secured to the right side (the upper side in FIG. 1) of a head main body 3 which defines side walls of a pressure chamber 2. Fixedly secured to the opposite side (the lower side in FIG. 1) of the head main body 3 is an oscillation plate 6 which compartments, together with the head main body 3, the pressure chamber 2. Further, a piezoelectric element 7, formed of a film of PZT, is fixedly secured to the lower side of the oscillation plate 6. In addition, a water repellent thin film 8, which contains therein a molecule in which fluoroalkyl chains are bonded to or dispersed in silicon oxide, is formed overlying the ink jetting side (the upper side in FIG. 1) of the nozzle plate 5.

Figure 2A:
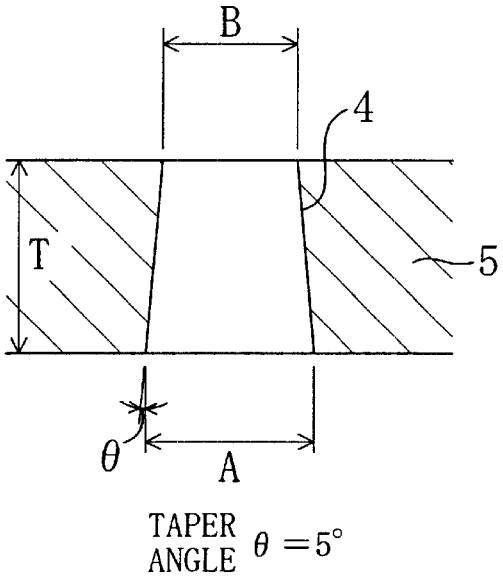
FIGS. 2(*a*) and 2(*b*) are cross-sectional views showing, respectively, concrete examples of the nozzle plate.
Figure 2B:
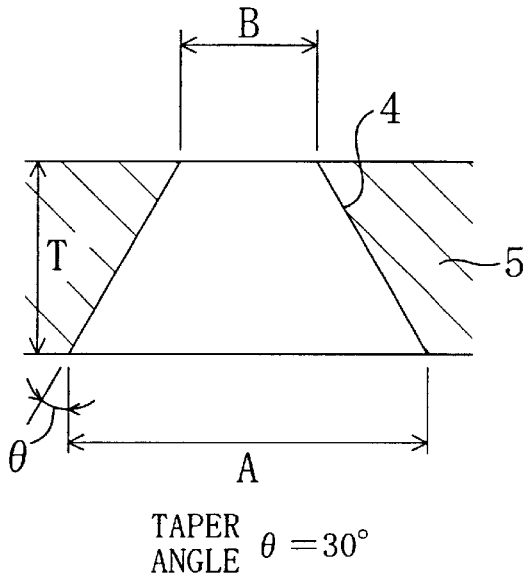

It is preferred that the film thickness of the water repellent thin film 8 ranges from 10 nm up to 1000 nm, more preferably, from 100 nm up to 300 nm. It is preferred that the thickness of the nozzle plate 5 ranges from 0.01 mm up to 0.1 mm. It is preferred that the diameter (B) of a jet opening of the nozzle orifice 4 ranges from 14 $\mu$m up to 28 $\mu$m and its taper angle ($\theta$) preferably ranges from 5 degrees up to 60 degrees. For example, as FIG. 2(*a*) shows, these values may be set such that T (the thickness of the nozzle plate 5) =30 $\mu$m, $\theta$ (the taper angle of the nozzle orifice 4) =5 degrees, A (the diameter of a supply opening of the nozzle orifice 4) =19.25 $\mu$m to 33.25 $\mu$m, and B (the jet opening diameter of the nozzle orifice 4) =14 $\mu$m to 28 $\mu$m. Alternatively, as shown in FIG. 2(*b*), the values may be set such that T (the thickness of the nozzle plate 5) =30 $\mu$m, $\theta$(the taper angle of the nozzle orifice 4) =30 degrees, A (the supply opening diameter of the nozzle orifice 4) =48.64 $\mu$m to 62.64 $\mu$m, and B (the jet opening diameter of the nozzle orifice 4) =14 $\mu$m to 28 $\mu$m.

Next, a way of forming the water repellent thin film 8 on the nozzle plate 5 of the ink jet head 1 of the present embodiment will be described. First, the following two types of liquids, namely a liquid A and a liquid B, are prepared.

| | |
|---|---|
| LIQUID A: | |
| 2,2,2-trifluoroethanol | 50 ml |
| tetraethoxysilane ($Si(OC_2H_5)_4$) | 25 ml |
| KBM ($CF_3(CF_2)_7C_2H_4Si(OCH_3)_3$) | 4 ml |
| LIQUID B: | |
| 2,2,2-trifluoroethanol | 50 ml |
| water | 7 ml |
| hydrochloric acid | 0.4 ml |

Following the above preparation, the liquid A is decanted into a beaker whose internal cubic volume is 200 ml. While stirring the liquid A with a magnetic stirrer, the liquid B is dropped little by little with a dropping pipette into the liquid A to make, as a coat liquid, a mixed solution of the liquid A and the liquid B (see FIG. 3(*a*)).

Meanwhile, a base material of stainless steel (SUS) (length: 10 mm; width: 10 mm; thickness: 0.2 mm) is subjected to ultrasonic cleaning with a surface active agent and then to cleaning by flowing water for removing contaminants from the surface of the base material.

Following the above cleaning processing, the base material is placed in a spin coater and, after the coat liquid is dropped onto the base material, the base material is rotated at 500 rpm for five seconds, followed by 20 seconds at 300 rpm, whereby the coat liquid is applied.

Figures 3A, 3B:
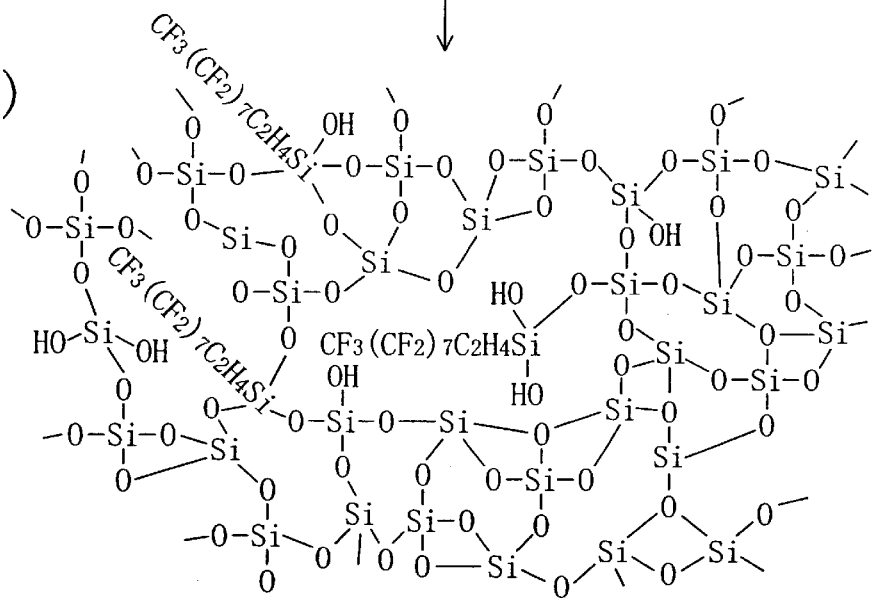
FIGS. 3(*a*) and 3(*b*) are diagrams for the description of steps of the manufacture of a water repellent thin film, FIG. 3(*a*) showing a reactions of a coat liquid, FIG. 3(*b*) showing a post-baking state of the coat liquid.

Next, the base material is removed from the spin coater and, after the base material is dried for one hour under room temperature condition, the base material is subjected to baking at 200 degrees centigrade for 30 minutes (see FIG. 3(*b*)). In this way, a water repellent thin film is formed uniformly on the surface of the base material, having a film thickness of about 0.2 $\mu$m.

Thereafter, the nozzle orifice 4 is formed in the base material. The nozzle orifice 4 may be formed by conventional machining such as excimer laser and punching machining; however, it is particularly preferable to employ an electrical discharge machining technique if the taper angle is to be increased. The reason is that in the conventional machining techniques the taper angle ($\theta$) is limited to somewhere between 5 degrees and 10 degrees. The electrical discharge machining provides such great latitude for the machining of the taper angle ($\theta$) that the machining range of the taper angle ($\theta$) is from 5 degrees up to 60 degrees and the electrical discharge machining is therefore a particularly suitable technique. Accordingly, the present embodiment employs an electrical discharge machining technique in order to form the nozzle orifice 4 from the lower side carrying thereon no water repellent thin film. As a result, the nozzle plate 5 is formed, with the water repellent thin film 8 applied on its upper surface.

However, the way of forming the nozzle orifice 4 is not limited to the electrical discharge machining. The nozzle orifice 4 can, of course, be formed by laser beam machining with excimer laser or the like. When the nozzle orifice 4 is formed making utilization of heat, as in the electrical discharge machining and the laser beam machining, molecules having water repellency, contained in a side wall portion 20 of the nozzle orifice 4 in the water repellent thin film 8, will vaporize. As a result, the portion 20 comes to loose water repellency. This accordingly prevents ink droplets from behaving unstably at the side wall portion 20 of the water repellent thin film 8, thereby stabilizing the state of jetting ink droplets from the nozzle orifice 4.

Additionally, the water repellent thin film of the present invention has a sufficiently thin film-thickness and exhibits a satisfactory degree of adhesion with respect to the base material, therefore making it possible to form the nozzle orifice 4 at a high accuracy even when the nozzle orifice 4 is formed by mechanical machining such as punching machining and blasting machining, without causing the water repellent thin film to peel off. Accordingly, if the diameter or the taper angle of the nozzle orifice 4 falls in the predefined range, this allows the preferable use of mechanical machining.

Thereafter, the nozzle plate 5 is secured tightly to the head main body 3 to complete the fabrication of the ink jet head 1. As a result, the ink jet head 1, in which the water repellent thin film 8 less readily peelable and superior in abrasion resistance has been formed, can be obtained.

In the ink jet head 1 of the present embodiment, the nozzle plate 5 maintains water repellency for a long period of time, thereby ensuring that the ink jetting performance will be maintained over a long period. Moreover, since the water repellent thin film 8 is not readily degraded, the constraint on the cleaning of the present ink jet head 1, such as the number of times wiping is carried out and the wiping pressure, is relaxed.

EMBODIMENT 2

Figure 4:
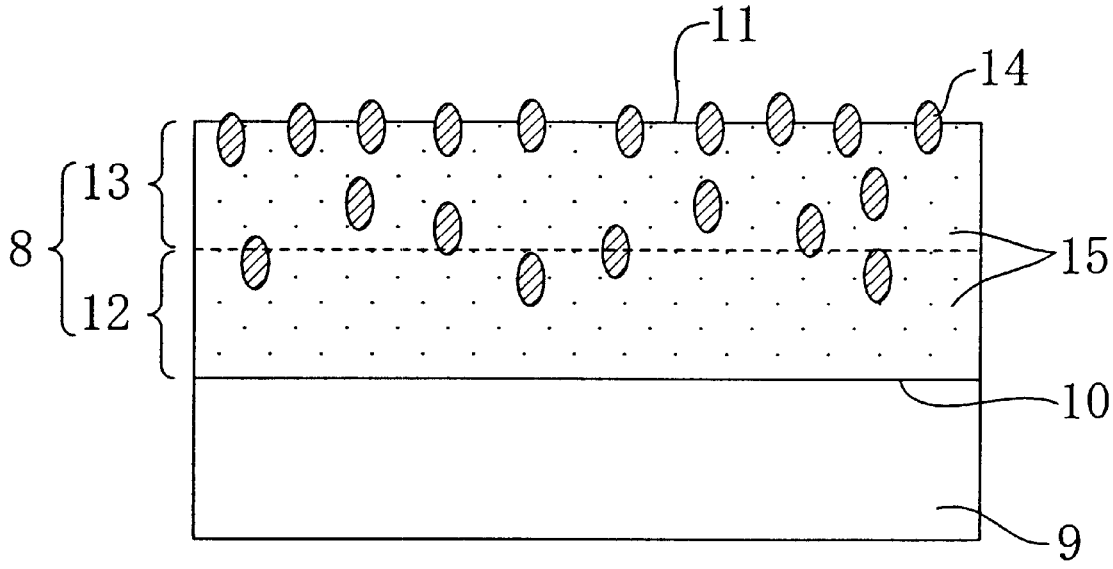
FIG. 4 is a schematic diagram showing a distribution of water repellent molecules inside a water repellent thin film.

As schematically shown in FIG. 4, an ink jet head according to a second embodiment of the present invention is formed such that the density of a molecule 14 as a water repellent molecule having a fluoroalkyl chain in the water repellent thin film 8 is thicker at the side of an upper surface 11 (i.e., the jetting side) than at the side of an interface 10 with the nozzle plate 5 (i.e., the base material 9).

Since the water repellent molecule 14 is generally low in compatibility with a silica network 15, the density of the water repellent molecule 14 has a tendency of thickening toward interfaces on either side of the water repellent thin film 8 (i.e., toward the upper surface 11 and toward the interface 10 on the base material's 9 side). So, if the water repellent molecule 14 is thick in density at the side of the upper surface 11 of the water repellent thin film 8, this provides the advantage that the water repellency of the upper surface 11 is enhanced. However, conversely, if the density at the side of the interface 10 with the base material 9 is thick, this results in producing the disadvantage that the degree of adhesion between the water repellent thin film 8 and the base material 9 drops. To cope with such a problem, in the present embodiment, the density at the side of the interface 10 is made thin in order to enhance the degree of adhesion between the water repellent thin film 8 and the base material 9, while on the other hand the density at the side of the upper surface 11 is made thick in order to enhance the water repellency thereof.

In the present embodiment, first and second coat liquids shown in Table are first prepared.

TABLE

| | | |
|---|---|---|
| FIRST COAT LIQUID | | |
| LIQUID A1 | 2,2,2-torifluoroethanol | 50 ml |
| | TEOS | 25 ml |
| LIQUID A2 | 2,2,2-torifluoroethanol | 50 ml |
| | water | 7 ml |
| | hydrochloric acid | 0.4 ml |
| SECOND COAT LIQUID | | |
| LIQUID B1 | 2,2,2-torifluoroethanol | 50 ml |
| | TEOS | 25 ml |
| | KBM | 4 ml |
| LIQUID B2 | 2,2,2-torifluoroethanol | 50 ml |
| | water | 7 ml |
| | hydrochloric acid | 0.4 ml |

TEOS (tetraethoxysilane): $Si(OC_2H_5)_4$
KBM: $CF_3(CF_2)_7C_2H_4Si(OCH_3)_3$

The first coat liquid is prepared as follows. First, the liquid A1 is decanted into a beaker whose internal cubic volume is 200 ml. While stirring the liquid A1 with a magnetic stirrer, the liquid A2 is dropped little by little into the liquid A1 with a dropping pipette to make, as the first coat liquid, a mixed solution of the liquid A1 and the liquid A2. Likewise, the second coat liquid is prepared as follows. First, the liquid B1 is decanted into a beaker whose internal cubic volume is 200 ml. While stirring the liquid B1 with a magnetic stirrer, the liquid B2 is dropped little by little into the liquid B1 with a dropping pipette to make, as the second coat liquid, a mixed solution of the liquid B1 and the liquid B2.

Next, a base material of stainless steel (SUS) (length: 10 mm; width: 10 mm; thickness: 0.2 mm) is subjected to ultrasonic cleaning with a surface active agent and then to cleaning by flowing water for removing contaminants from the surface of the base material.

Following the above cleaning processing, the base material is placed in a spin coater and, after the first coat liquid is dropped onto the base material, the base material is rotated at 500 rpm for five seconds, followed by 20 seconds at 300 rpm, whereby the first coat liquid is applied. Following the application of the first coat liquid, the second coat liquid is dropped onto the base material. Thereafter, the base material is rotated at 500 rpm for five seconds, followed by 20 seconds at 300 rpm, whereby the second coat liquid is applied.

Next, the base material is removed from the spin coater and, after the base material is dried for one hour under room temperature condition, the base material is subjected to baking at 200 degrees centigrade for 30 minutes.

As a result, a water repellent thin film having a film thickness of about 0.2 $\mu$m is formed uniformly on the surface of the base material. The static contact angle of the formed water repellent thin film with respect to water was measured. The measurement showed that the contact angle was 110 degrees, from which it was confirmed that the formed water repellent thin film was high in water repellency.

Further, in accordance with the present embodiment, the first coat liquid, i.e., the coat liquid which is applied in the first place, does not contain therein KBM which is a water repellent molecule, and the KBM is contained only in the second coat liquid which is applied in the second place. As a result of such arrangement, the molecule 14 having a fluoroalkyl chain is more dense at the side of the upper surface 11 than at the side of the interface 10. Further, after the application of the first coat liquid, the second coat liquid is applied without subjecting the first coat liquid to drying and baking, therefore causing the fluoroalkyl-containing molecule to enter the inside of a first layer 12 formed by the application of the first coat liquid. However, the molecule 14 will not reach the bottom of the first layer 12, i.e., the portion in the vicinity of the interface 10, so that the portion in the vicinity of the interface 10 is placed in a state in which the water repellent molecule 14 is nonexistent. Accordingly, the degree of adhesion between the water repellent thin film 8 and the base material 9 is enhanced, so that the water repellent thin film 8 becomes less peelable from the base material 9.

Moreover, in spite of the presence of the water repellent molecule 14 between a second layer 13 formed by the application of the second coat liquid and the first layer 12, TEOS contained in both the first and second coat liquids is dehydration polymerized in a baking process, for the second coat liquid is applied without subjecting the first coat liquid to drying and baking. As a result, the degree of adhesion between the first layer 12 and the second layer 13 is high, therefore preventing the peeling-off of the second layer 13.

The surface of the water repellent thin film 8 was removed little by little by physical etching with ions of argon, for analyzing, by the Auger method, the element ratio of a fluorine atom which is a constituent atom of the water repellent molecule, and it was confirmed that the fluorine atom density was high at the upper surface 11, but it thinned out toward the interface 10.

Thereafter, as in the first embodiment, the nozzle orifice 4 is formed in the base material 9 and the water repellent thin film 8 by electrical discharge machining to complete the fabrication of the nozzle plate 5 which is then secured tightly to the head main body 3.

Each of the above-described first and second embodiments employs spin-coating as a method of applying a coat liquid. However, the coat liquid application method is not limited to the spin-coating. Other coat liquid application methods including dipping and spraying are, of course, applicable.

2,2,2-trifluoroethanol is used as a solvent. However, any other solvent, such as ethanol and propanol, can be used as a solvent, as long as it dissolves KBM.

The water repellent molecule can be any methoxysilane compound of the kind defined by $CF_3(CF_2)_nC_2H_4Si(OCH_3)_3$ where the number n ranges from 1 to 15. Moreover, the water repellent molecule can be any ethoxysilane compound of the kind defined by $CF_3(CF_2)_nC_2H_4Si(OC_2H_5)_3$ where the number n ranges from 1 to 15. The number n is preferably 4 or greater because the molecule water repellency is enhanced when the number n is 4 or greater.

It will be appreciated by those of ordinary skill in the art that the invention is not limited to any one of the foregoing embodiments and can be embodied in other specific forms without departing from the spirit or essential character thereof.

The presently disclosed embodiments are therefore considered in all respects to be illustrative and not restrictive. The scope of the invention is indicated by the appended claims rather than the foregoing description, and all changes which come within the meaning and range of equivalence thereof are intended to be embraced therein.

What is claimed is:

1. A method of manufacturing an ink jet head having a nozzle member on which surface a water repellent thin film has been formed, said method comprising the steps of:

applying, onto a surface of said nozzle member, a first coat liquid in which a methoxysilane or ethoxysilane compound which is a precursor of silicon oxide is dissolved;

applying, onto said nozzle member surface coated with said first coat liquid, prior to drying of said first coat liquid, a second coat liquid in which a methoxysilane or ethoxysilane compound which is a precursor of silicon oxide and an ethoxysilane or methoxysilane compound which contains therein a carbon fluoride chain are dissolved; and thereafter, drying said nozzle member.

2. A method of manufacturing an ink jet head having a nozzle member on which surface a water repellent thin film has been formed, said method comprising the steps of:

(a) applying, onto a surface of said nozzle member, a first coat liquid in which a methoxysilane or ethoxysilane compound which is a precursor of silicon oxide is dissolved;

(b) applying, onto said nozzle member surface coated with said first coat liquid, prior to drying of said first coat liquid, a second coat liquid in which a methoxysilane or ethoxysilane compound which is a precursor of silicon oxide and an ethoxysilane or methoxysilane compound which contains therein a carbon fluoride chain are dissolved;

(c) drying said nozzle member; and (d) forming a nozzle orifice in said nozzle member by electrical discharge machining.

* * * * *

UNITED STATES PATENT AND TRADEMARK OFFICE

CERTIFICATE OF CORRECTION

PATENT NO. : 6,627,264 B1
DATED : September 30, 2003
INVENTOR(S) : Kenji Tomita et al.

It is certified that error appears in the above-identified patent and that said Letters Patent is hereby corrected as shown below:

Title page,
Item [54], Title, "WATER REPELLENT" should be -- WATER-REPELLENT --

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,627,264 B1
DATED : September 30, 2003
INVENTOR(S) : Kenji Tomita et al.

It is certified that error appears in the above-identified patent and that said Letters Patent is hereby corrected as shown below:

Title page,
Item [56], References Cited, U.S. PATENT DOCUMENTS, insert

| | | | |
|---|---|---|---|
| -- 5,693,365 | 12/1997 | Teranishi et al. | 427/163.1 |
| 6,352,338 | 03/2002 | Komuro | 347/64 |
| 5,910,372 | 06/1999 | Griffin et al. | 428/429 |
| 6,231,988 | 05/2001 | Kato et al. | 428,447 --. |

Signed and Sealed this

Twenty-ninth Day of November, 2005

JON W. DUDAS
*Director of the United States Patent and Trademark Office*